US006849007B2

(12) United States Patent
Morgan et al.

(10) Patent No.: US 6,849,007 B2
(45) Date of Patent: Feb. 1, 2005

(54) DIMPLE PATTERN FOR GOLF BALLS

(75) Inventors: William E. Morgan, Barrington, RI (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/361,574

(22) Filed: Feb. 11, 2003

(65) Prior Publication Data

US 2004/0157682 A1 Aug. 12, 2004

(51) Int. Cl.[7] ..... A63B 37/12
(52) U.S. Cl. ..... 473/378
(58) Field of Search ..... 473/378–385

(56) References Cited

U.S. PATENT DOCUMENTS 3,819,190 A * 6/1974 Nepela et al. ..... 473/383
4,560,168 A 12/1985 Aoyama ..... 273/232
4,948,143 A 8/1990 Aoyama ..... 273/232
4,960,281 A 10/1990 Aoyama ..... 273/232
4,971,330 A * 11/1990 Morell ..... 473/384
5,156,404 A * 10/1992 Oka et al. ..... 473/382
5,957,786 A 9/1999 Aoyama ..... 473/379
6,224,499 B1 * 5/2001 Ogg ..... 473/383
6,299,552 B1 10/2001 Morgan et al. ..... 473/384
6,358,161 B1 3/2002 Aoyama ..... 473/383

FOREIGN PATENT DOCUMENTS

GB 1381897 1/1975 ..... A63B/37/14

* cited by examiner

*Primary Examiner*—Raeann Gorden
(74) *Attorney, Agent, or Firm*—Swidler Berlin Shereff Friedman, LLP

(57) ABSTRACT

A golf ball having a dimpled surface that is subdivided into two or more distinct regions wherein different dimple placement schemes are used in different regions. A preferred embodiment has polar regions dimpled according to an octahedral-based dimple pattern and the equatorial region dimpled according to an icosahedron-based dimple pattern. This preferred embodiment has dimples of varying sizes and has 388 total dimples.

17 Claims, 13 Drawing Sheets

DIMPLE PATTERN FOR GOLF BALLS

BACKGROUND OF THE INVENTION

1. Field of the Invention

The present invention is directed to a golf ball and, more particularly, to a golf ball having an improved dimple pattern.

2. Description of the Related Art

Soon after the introduction of the smooth surfaced gutta percha golf ball in the mid nineteenth century, players observed that the balls traveled further as they got older and more gouged up. The players then began to roughen the surface of new golf balls with a hammer to increase flight distance. Manufacturers soon caught on and began molding non-smooth outer surfaces on golf balls, and eventually began to manufacture golf balls having dimples formed in the outer surface. Conventional dimples are depressions that act to reduce drag and increase lift. These dimples are formed where a dimple wall slopes away from the outer surface of the ball, forming the depression.

One method of packing dimples on a golf ball divides the surface of the golf ball into eight spherical triangles corresponding to the faces of an octahedron, which is a solid bounded by eight triangular plane faces. Dimples are then positioned within each of the surface divisions according to a placement scheme. The surface divisions may be further divided and the resulting subdivisions packed with dimples. Octahedron-based dimple patterns generally cover approximately 60–75% of the golf ball surface with dimples. U.S. Pat. Nos. 5,415,410 and 5,957,786 disclose octahedron-based dimple patterns.

Another dimple packing method divides the surface of the golf ball into 20 spherical triangles corresponding to the faces of an icosahedron, which is a polyhedron having triangular plane faces. Dimples are then positioned within each of the surface divisions according to a placement scheme. The surface divisions may be further divided and the resulting subdivisions packed with dimples. Because most icosahedron-based dimple patterns incorporate a high degree of hexagonal packing, they typically achieve more than 75% dimple coverage. U.S. Pat. Nos. 4,560,168 and 5,957,786 disclose icosahedron-based dimple patterns.

The dimples on a golf ball are important in reducing drag and increasing lift. Drag is the air resistance that acts on the golf ball in the direction opposite the ball's flight direction. As the ball travels through the air, the air that surrounds the ball has different velocities and, thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball acts to slow the ball down. This is the primary source of drag for golf balls.

The dimples on the golf ball cause a thin boundary layer of air adjacent the outer surface of the ball to flow in a turbulent manner. Thus, the thin boundary layer is called a turbulent boundary layer. The turbulence energizes the boundary layer and helps move the separation point further backward, so that the layer stays attached further along the outer surface of the ball. As a result, there is a reduction in the area of the wake, an increase in the pressure behind the ball, and a substantial reduction in drag.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air below the ball. This pressure difference results in the overall force, called lift, which is exerted upwardly on the ball. For additional discussion regarding golf ball aerodynamics, see copending patent application Ser. Nos. 09/989,191 entitled "Golf Ball Dimples with a Catenary Curve Profile," filed on Nov. 21, 2001 and Ser. No. 09/418,003 entitled "Phyllotaxis-Based Dimple Patterns," filed on Oct. 14, 1999, now U.S. Pat. No. 6,338,684.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities.

The United States Golf Association (USGA) promulgates rules, one of which is directed to the symmetry of a golf ball. The USGA symmetry requirement dictates that a golf ball must be designed and manufactured to perform in general as if it were spherically symmetrical. Most dimple patterns tend to generate different flight characteristics based upon the orientation of the ball. For example, most icosahedron-based patterns have a tendency to fly slightly lower and longer in the poles-horizontal position (where the poles are oriented horizontally across the target line) than in the pole-over-pole, or poles-vertical, position. This is partially due to the manufacturing process; since most golf ball dimples are formed using a two-piece mold, the two pieces being mated at a parting line (i.e., the equator of the ball), most golf balls have at least one great circle that corresponds to the parting line of the molds and upon which no dimples are formed. In addition, most icosahedron-based patterns have more densely packed dimples near the pole than near the equator. Since the relative lack of dimples along the equator of the ball affects the aerodynamic performance of the ball, other areas of the ball must be modified in order to comply with the USGA symmetry rule.

One solution to the asymmetrical problem is to balance the parting line with additional great circles about the surface of the golf ball upon which no dimples are formed. These are known as "false parting lines." Two such parting lines are typically used on an octahedron-based layout, bringing the total number of parting lines on the ball to three. One of the drawbacks of such patterns is that many dimples placed within the pattern will follow parallel latitudinal paths resulting in aligned rows of dimples, which can provide poor flight characteristics. (See U.S. Pat. No. 4,960,281 describing dimple non-alignment). Another drawback is that the multiple great circles reduce the percentage of the golf ball surface that can be filled with dimples.

Another way to overcome the asymmetry caused by the parting line is to alter the dimples around the poles. However, this raises the trajectory and shortens the distance of the poles-horizontal orientation to match those of the pole-over-pole orientation, lowering the overall aerodynamic performance of the ball.

Thus, what is needed is an improved dimple pattern for golf balls that provides high dimple coverage while simultaneously providing symmetrical flight characteristics.

SUMMARY OF THE INVENTION

The present invention is directed to a golf ball having a dimpled surface that is subdivided into two or more distinct regions wherein different dimple placement schemes are used in different regions. A preferred embodiment has polar regions dimpled according to an octahedral-based dimple pattern and the equatorial region dimpled according to an icosahedron-based dimple pattern. This preferred embodiment has dimples of varying size, and has 388 total dimples.

In a first preferred embodiment of the present invention, a golf ball comprises an outer surface having dimples therein. Some of the dimples are positioned on the outer surface according to a first dimple placement scheme, and some of the dimples are positioned on the outer surface according to a second and distinct dimple placement scheme. The dimples of the first dimple placement scheme are positioned within a first region of the golf ball surface, and the dimples of the second dimple placement scheme are positioned within a second region of the golf ball surface. The dimples are arranged on the ball such that the dimple count is biased towards the poles and the dimple volume is biased towards the equator.

There are a plurality of great circle arcs upon which no dimples are formed, but there is no great circle upon which no dimples are formed. Each of the arcs extends from a selected one of the poles toward the equator and terminates at a point between the selected pole and the equator. The arcs are confined to the first region, and may be perpendicular to the parting line.

The first dimple placement scheme preferably comprises an octahedron-based dimple pattern, and the second dimple placement scheme preferably comprises an icosahedron-based dimple pattern. The second region is preferably an equatorial region and may be bisected by a single great circle upon which no dimples are formed. Alternatively, the second region includes no great circle upon which no dimples are formed. The first and second regions are distinguished by a latitudinal line, which is preferably undimpled.

In a second preferred embodiment of the present invention, a golf ball comprises an outer surface with dimples, including a first set of dimples and a second set of dimples. The dimples within the first set are arranged on the outer surface according to a first dimple placement scheme, and the dimples within the second set are arranged on the outer surface according to a second dimple placement scheme, the first scheme being different than the second scheme.

The first dimple placement scheme preferably comprises an octahedron-based dimple pattern, and the second dimple placement scheme preferably comprises an icosahedron-based dimple pattern. The octahedron-based dimple pattern preferably is biased toward a pole of the golf ball and the icosahedron-based dimple pattern preferably is biased toward an equator of the golf ball.

The golf ball may include a third set of dimples arranged on the outer surface according to a third dimple placement scheme. The first and third sets are biased toward the poles of the golf ball and the second set is biased toward the equator of the golf ball. The third dimple placement scheme preferably is the same as the first dimple placement scheme.

In a third preferred embodiment of the present invention, a golf ball has an outer surface with a plurality of dimples formed therein. The dimples are arranged by dividing the outer surface into eight spherical triangles (or major spherical triangles), each of the eight spherical triangles being subdivided into first and second zones. The dimples are arranged according to a first dimple placement scheme in the first zone and according to a second dimple placement scheme in the second zone, wherein the first and second dimple placement schemes are mutually distinct. The first zone preferably is a spherical triangle (or minor spherical triangles) and the second zone preferably is a spherical trapezoid. The terms "major spherical triangle" and "minor spherical triangle" are used for purposes of distinction. Each of the major spherical triangles preferably is substantially identical, and each major spherical triangle preferably extends from one of the poles to the equator.

Four adjacent minor spherical triangles may define a single distinct region on the ball surface, the region having a common dimple placement scheme throughout. The dimple placement scheme within the region includes a subdivision of the region by a plurality of great circle arcs upon which no dimples are formed.

The eight spherical trapezoids may define a single distinct region on the ball surface, the region having a common dimple placement scheme throughout. In one alteration, the region may be subdivided by a single great circle located at a parting line and upon which no dimples are formed. In a second alteration, the region cannot be subdivided by an arc of a great circle upon which no dimples are formed.

A first set of four adjacent minor spherical triangles may define a first distinct region on the ball surface about one of the poles, the first region having a common dimple placement scheme throughout. The eight spherical trapezoids may define a second distinct region on the ball surface about the equator, the second region having a common dimple placement scheme throughout. A second set of four adjacent minor spherical triangles comprise a third distinct region on the ball surface about the other of the poles, the third region having a common dimple placement scheme throughout. The dimple placement schemes of the first and third regions may be the same and preferably are distinct from the dimple placement scheme of the second region.

The first dimple placement scheme preferably comprises an octahedron-based dimple pattern, and the second dimple placement scheme preferably comprises an icosahedron-based dimple pattern. The dimples are preferably arranged such that there are a plurality of great circle arcs upon which no dimples are formed, but there is no great circle upon which no dimples are formed. Each of the arcs preferably extends from a selected one of the poles toward the equator and terminates at a point between the selected pole and the equator.

In the preferred embodiments, the dimples are of eight different sizes. The dimples within the first zone comprise five dimple sizes and the dimples within the second zone comprise three dimple sizes. There preferably are 388 total dimples.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
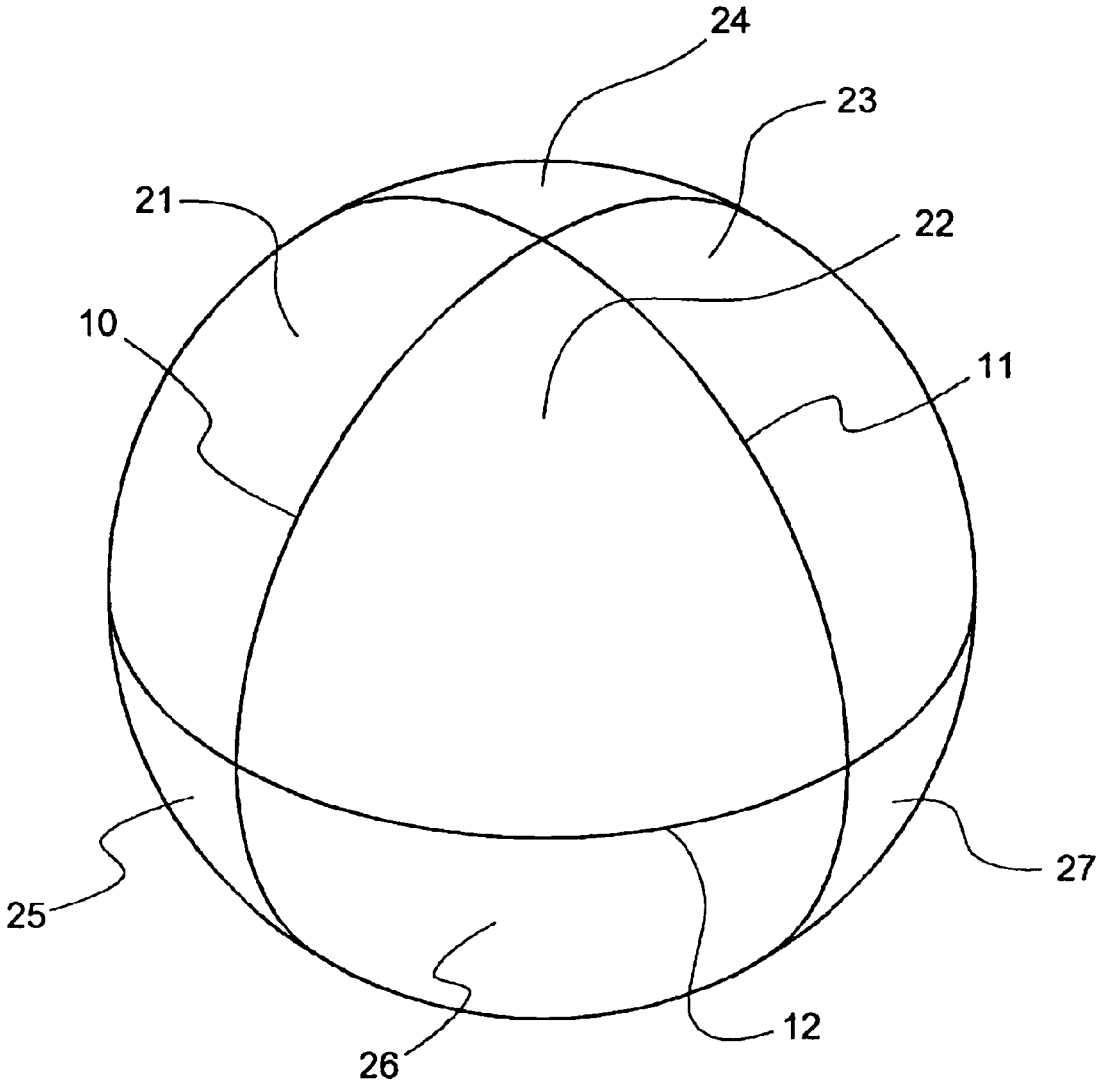
FIG. 1 illustrates spherical triangular regions on the surface of a sphere corresponding to the eight faces of an octahedron.

FIGS. 1–4 illustrate an octahedron dimple pattern having 336 dimples. FIG. 1 shows the surface of the undimpled golf ball divided into eight identical spherical triangular regions 21, 22, 23, 24, 25, 26, 27, and 28 (not visible) that correspond to the faces of a regular octahedron. The boundaries of these regions comprise three mutually orthogonal great circle paths 10, 11, and 12.

Figure 2:
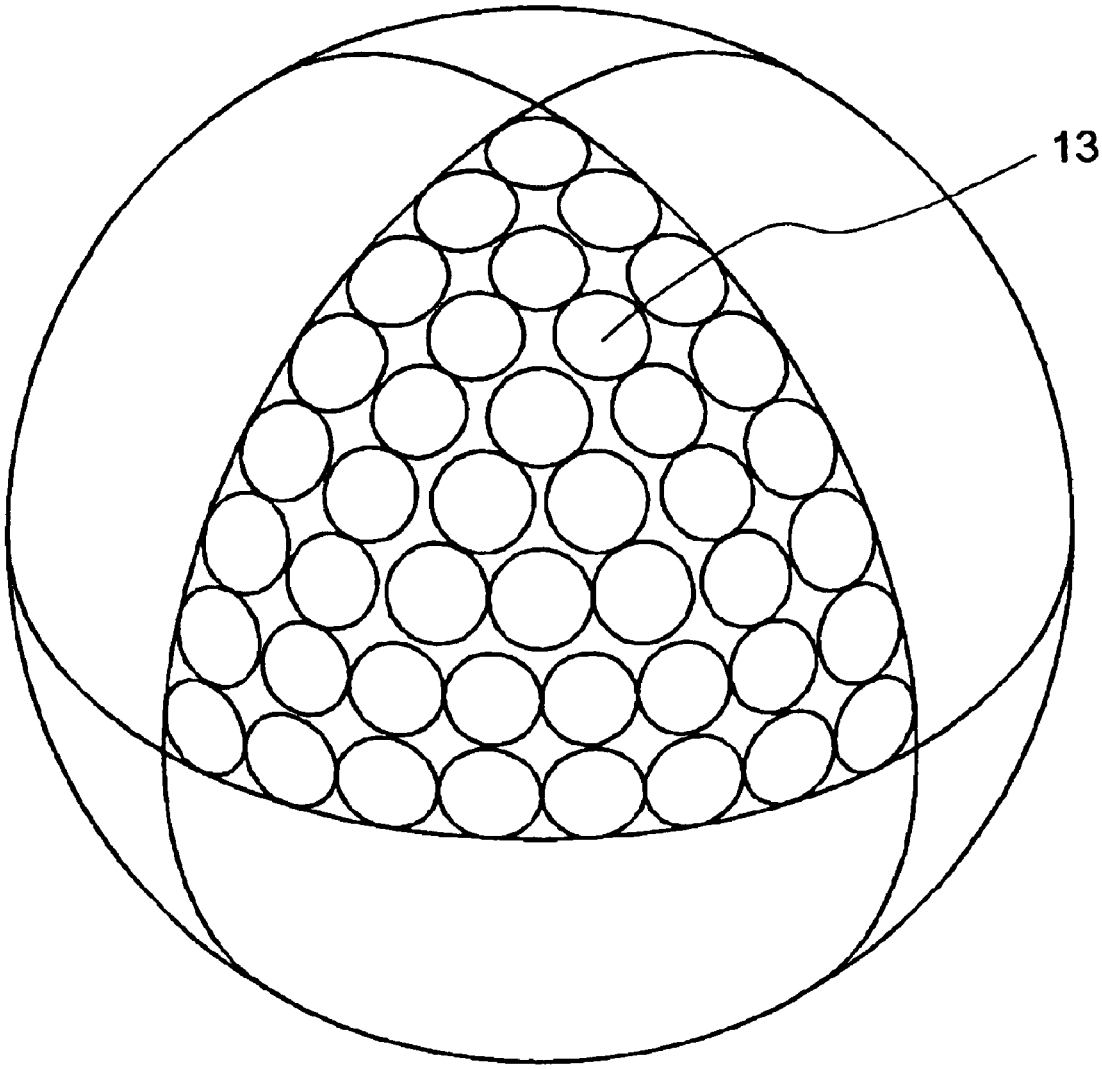
FIG. 2 illustrates one triangular region of FIG. 1 filled with a preferred arrangement of dimples.

In FIG. 2, region 22 has been filled with 42 dimples 13 arranged in three concentric triangular rings. The outer ring includes 21 dimples, the intermediate ring includes 15 dimples, and the inner ring includes 6 dimples. Preferably these dimples are sized and positioned in such a way as to maximize coverage of the ball surface. This grouping of dimples is the basic element that makes up the entire dimple pattern.

Figure 3:
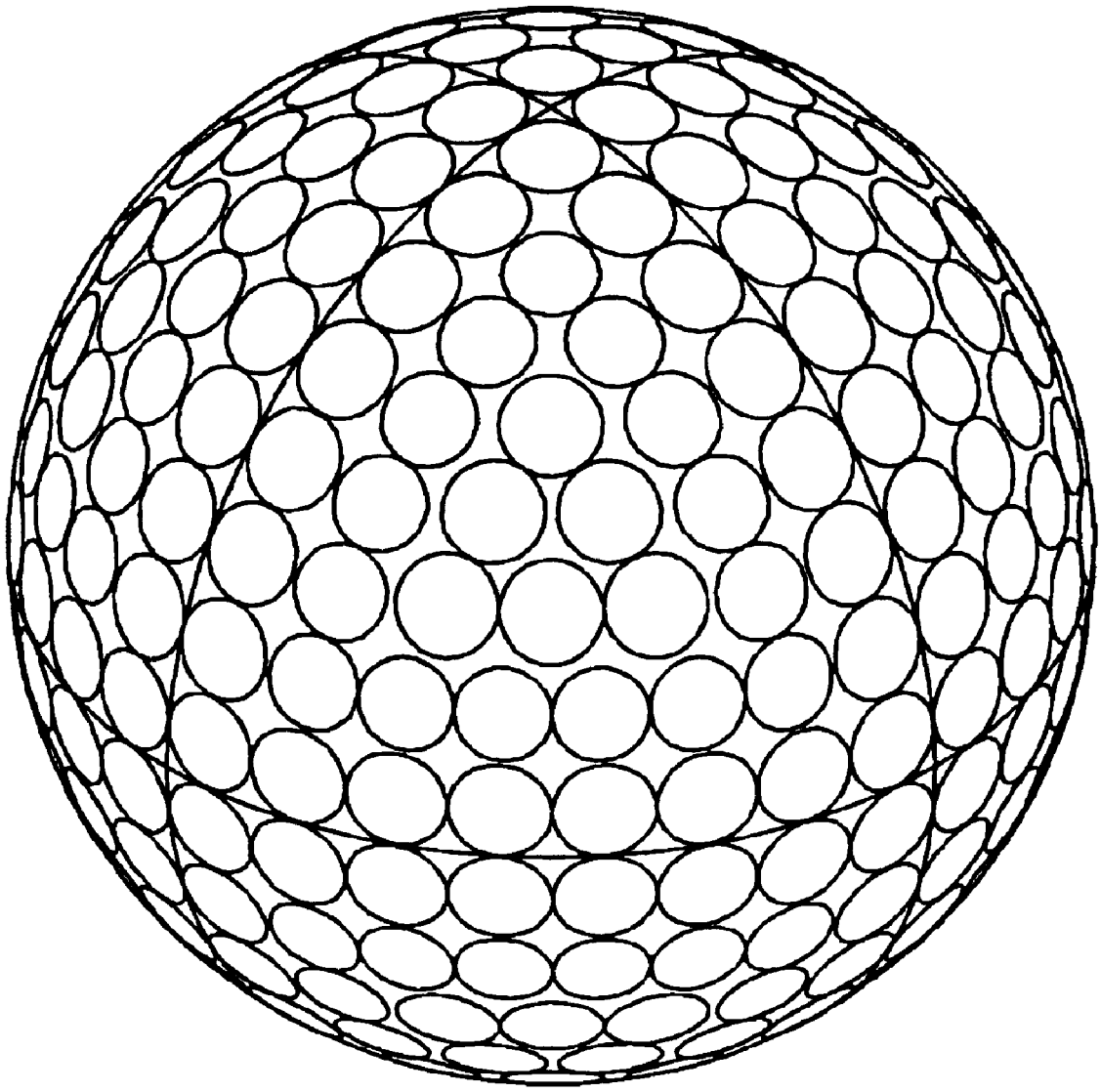
FIG. 3 illustrates a complete preferred dimple pattern comprising all eight of the triangular regions of FIG. 1 filled with the dimple arrangement of FIG. 2.

FIG. 3 shows the completed dimple pattern that is created by filling each of the other regions 21, 23, 24, 25, 26, 27, and 28 with an identical grouping of dimples as in region 22.

Figure 4:
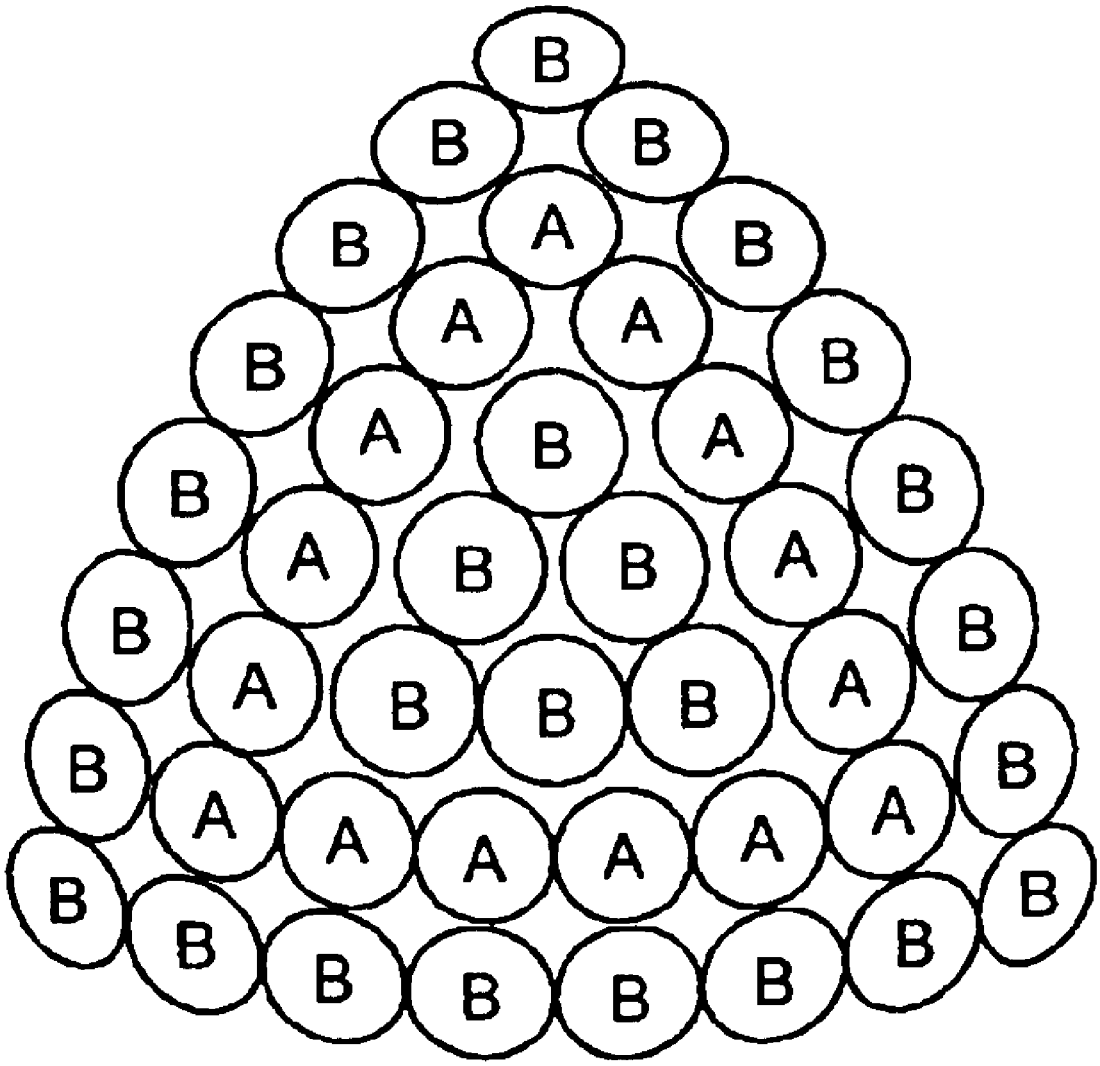
FIG. 4 illustrates the different sizes of dimples used in the preferred arrangement of FIG. 2.

As shown in FIG. 4, a preferred configuration of dimples within each of regions 21–28 includes dimples of two sizes, A and B. Table 1 below gives preferred values for the diameters of dimples A and B.

TABLE 1

| Dimple | Diameter (in.) |
|---|---|
| A | 0.153 |
| B | 0.163 |

Figure 5:
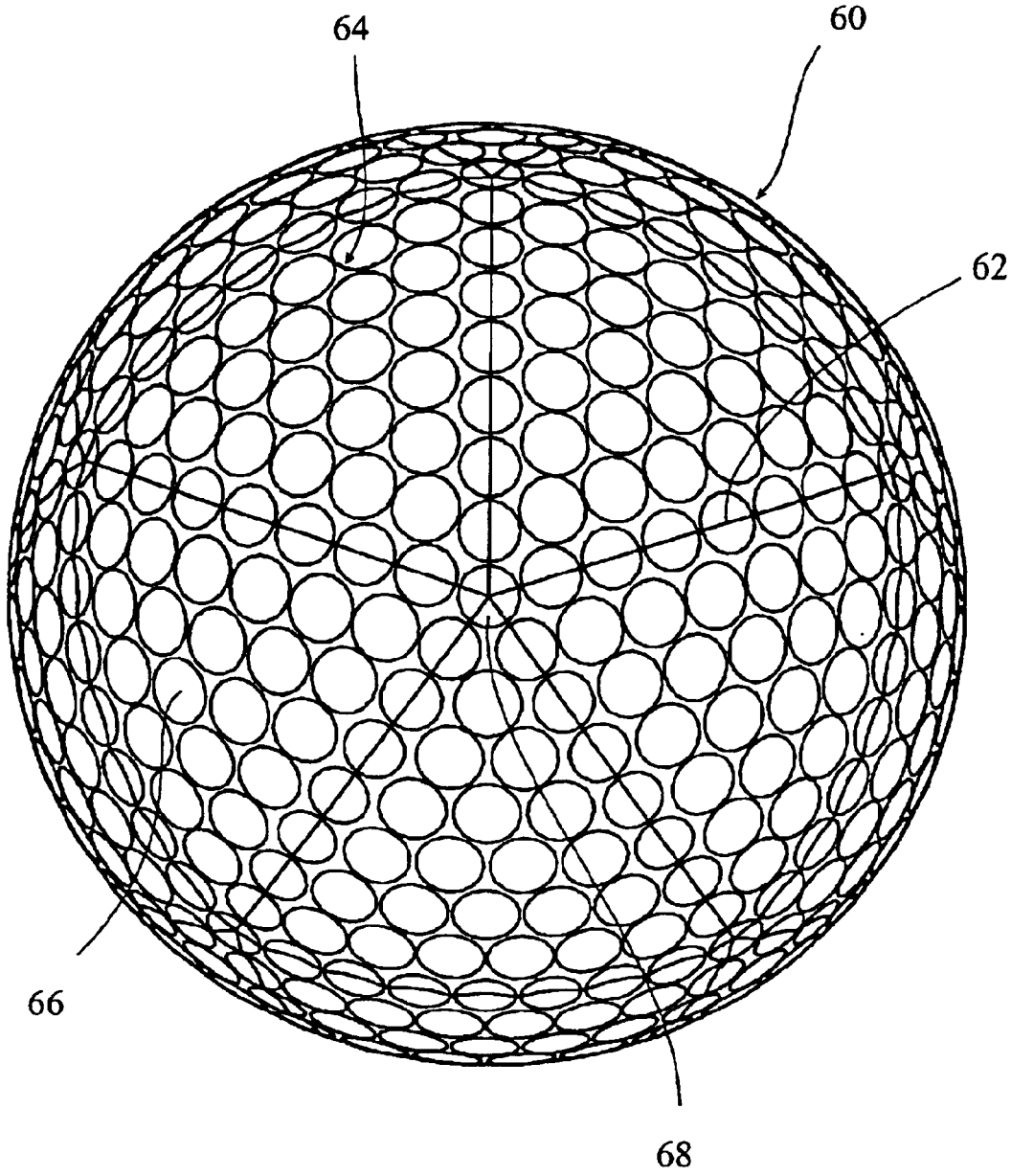
FIG. 5 illustrates a perspective view of a golf ball having an icosahedron dimple pattern.
Figure 6:
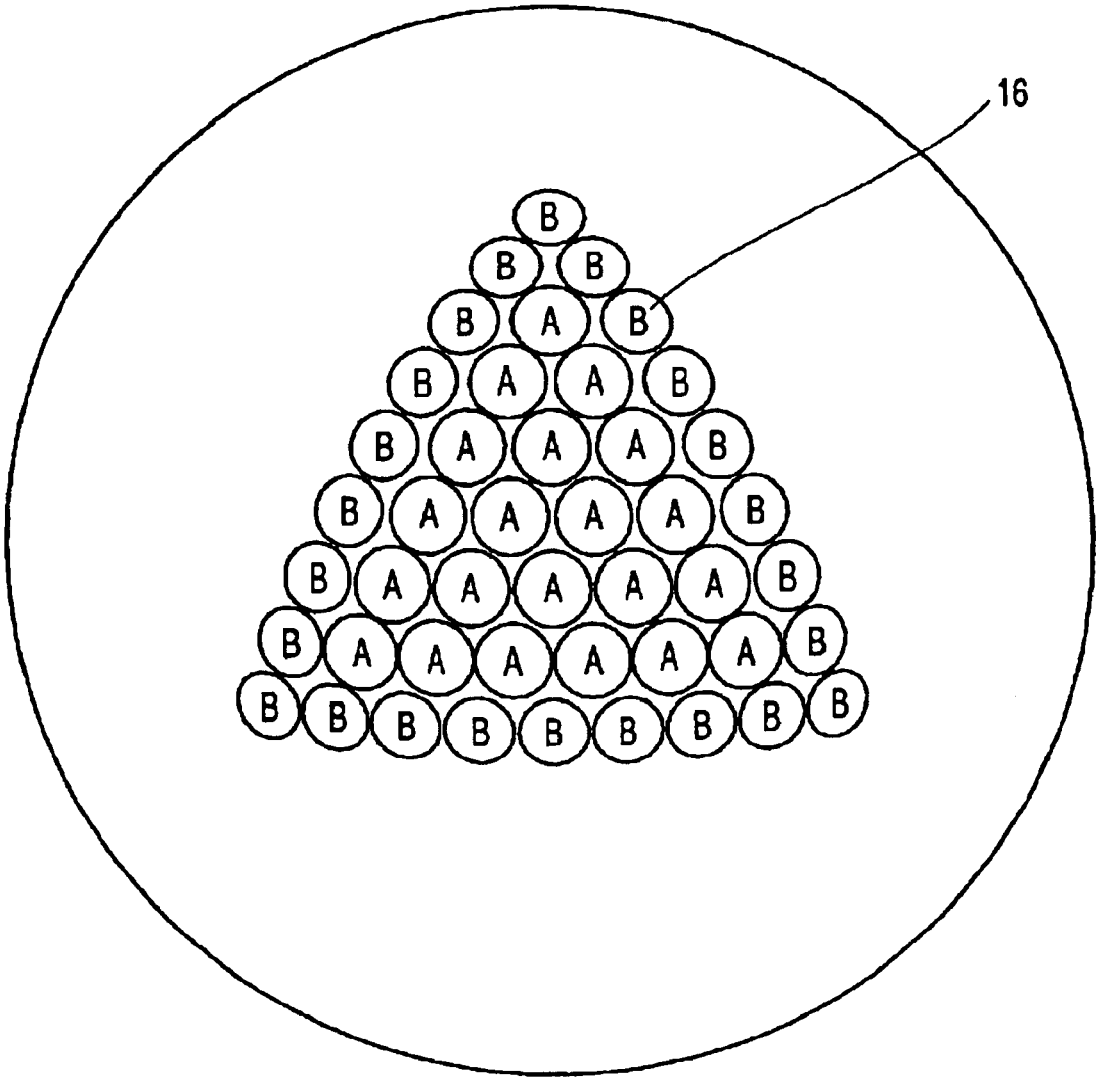
FIG. 6 illustrates a spherical triangle of FIG. 5.
Figure 7:
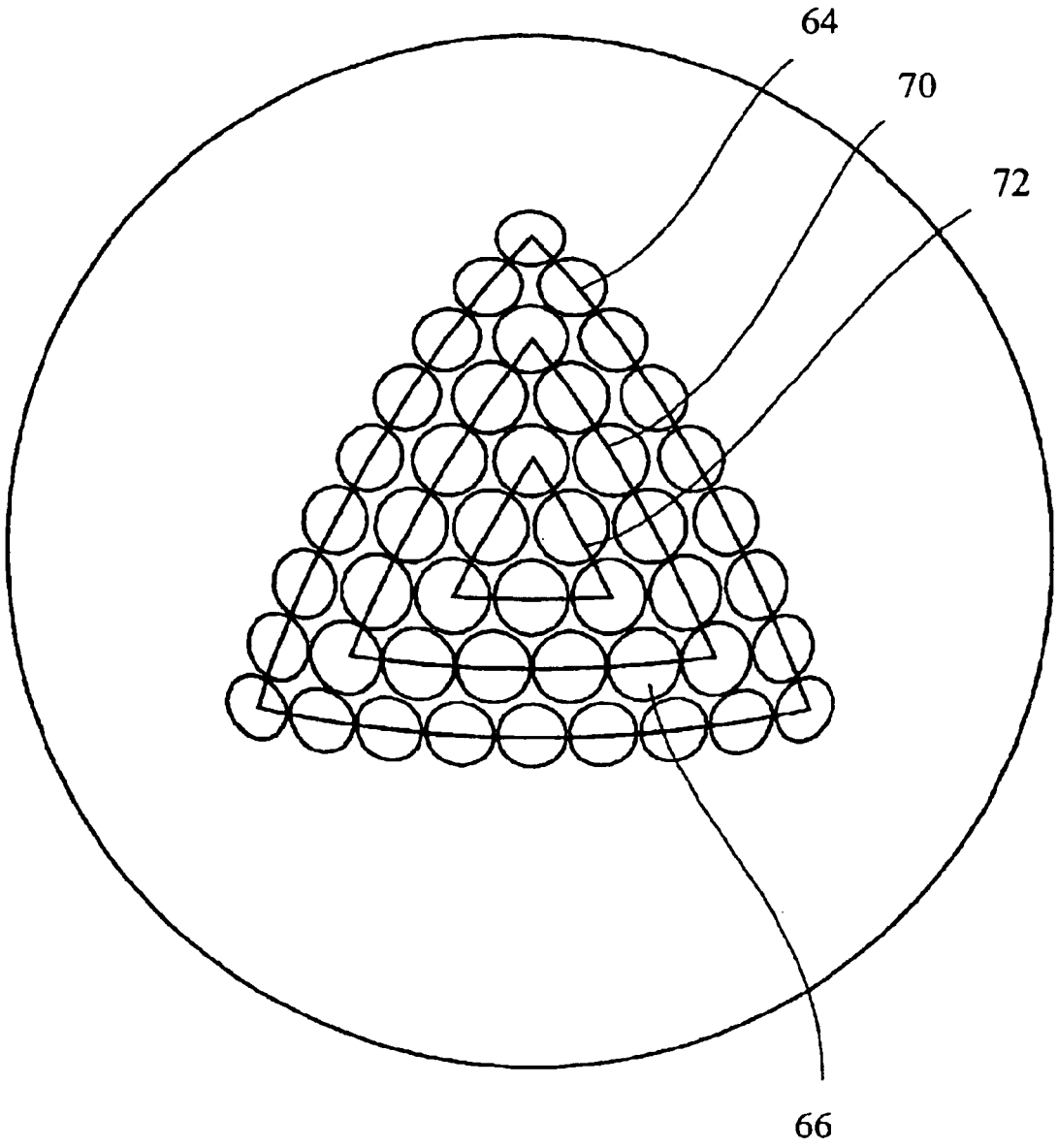
FIG. 7 illustrates a spherical triangle of FIG. 5.

FIGS. 5–9 illustrate an icosahedron dimple pattern having 642 dimples. Referring to FIGS. 5–7, solid lines 62 shown in FIG. 5 on golf ball 60 form twenty icosahedral spherical triangles 64, which correspond to faces of a regular icosahedron. Golf ball 60 has a pattern of dimples 66 that is substantially repeated in each icosahedral triangle 64. The icosahedron pattern has five triangles 64 formed at both the top and bottom polar regions of the ball 60. Each of the five triangles 64 shares a vertex dimple 68. There are also ten triangles 64 that extend around the equatorial region of the ball 60.

FIGS. 6 and 7 provide the detailed layout of one of the triangles 64 of FIG. 5. This dimple pattern includes dimples 66 of sizes M and N formed in concentric triangles 64, 70, and 72. Dimples N, disposed along the edges of the icosahedral triangle 64, have a smaller diameter than dimples M, which are disposed centrally within the icosahedral triangle 64, along the edges of triangles 70 and 72.

Each of the edges of triangles 64 and 72 has an odd number of dimples 66, and each of the edges of triangle 70 has an even number of dimples 66. Each triangle 64 and 70 has nine more dimples 66 on its edges than do its respective adjacent, smaller triangles 70 and 72. The large triangle 64 has a total of nine more dimples 66 on its edges than does middle triangle 70, and middle triangle 70 has nine more dimples 66 than does small triangle 72. Adjacent rows of dimples 66 are relatively staggered.

This creates a hexagonal packing in which almost all dimples 66 are surrounded by six other dimples 66. Preferably at least 75% of the dimples 66 have six adjacent dimples 66. More preferably, only the vertex dimples 68 do not have hexagonal packing.

Figure 8:
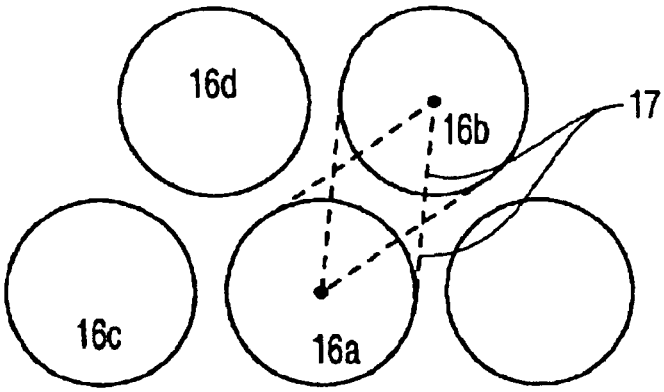
FIG. 8 illustrates some of the dimples of the golf ball of FIG. 5.
Figure 9:
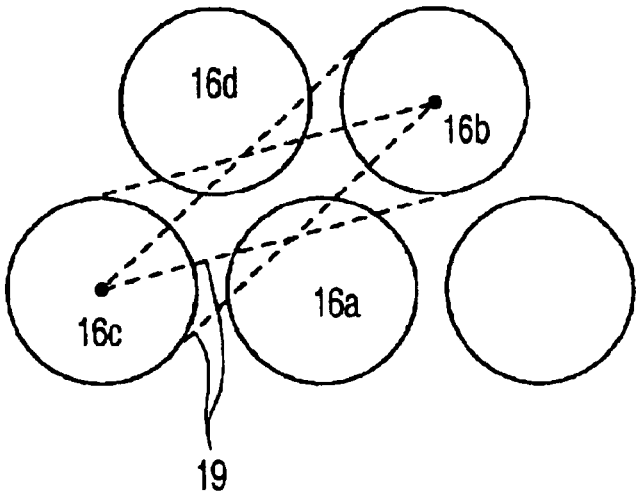
FIG. 9 illustrates some of the dimples of the golf ball of FIG. 5.

For purposes of this patent, as shown in FIG. 8, any two dimples 66, such as dimples 66*a* and 66*b*, are considered adjacent where four line segments 74, including two lines segments 74 drawn from a point tangent to each dimple 66*a* and 66*b* to the center of the other dimple 66*a* and 66*b*, do not intersect any other dimple 66. Dimples 66*b* and 66*c*, however, are not adjacent, as shown in FIG. 9, as at least one of line segments 76, extending tangent to one of the dimples 66*b* and 66*c* to the center of the other dimple 66*b* and 66*c*, intersects another dimple 66*a* or 66*d*. Also, dimples with edges within about 0.03 inches of one another are also considered adjacent. For simplicity, the examples of FIGS. 8 and 9 show the dimples lying on a flat surface, but it is understood that dimples on a ball lie on a spherically curved surface, and line segments 74 and 76 extend along great circle arcs.

Preferably, less than 30% of the spacings between adjacent dimples 66 are greater than 0.01 inches. More preferably, less than 15% of the spacings between adjacent dimples 66 are greater than 0.01 inches.

In the golf ball shown in FIGS. 5–7, there is no great circle path that does not intersect any dimples 66. This increases the percentage of the outer surface that is covered by dimples 66. Golf balls according to the icosahedron dimple pattern preferably have dimples 66 arranged so that there is one great circle path that does not intersect any dimples 66. There is more preferably no great circle path that does not intersect any dimples 66.

Providing one great circle along the equator that does not intersect any dimples 66 facilitates manufacturing, particularly the step of buffing the parting line of the golf balls after demolding. Furthermore, many players prefer to have an equator without dimples that they can use to line up the ball for putting. Thus, dimple patterns often have modified triangles 64 around the mid-section to create the equator that does not intersect any dimples 66.

In this icosahedron dimple pattern, the diameters of the dimples 66 are as given in Table 2 below.

TABLE 2

| Dimple | Diameter (in.) |
|---|---|
| M | 0.120 |
| N | 0.110 |

Figure 10:
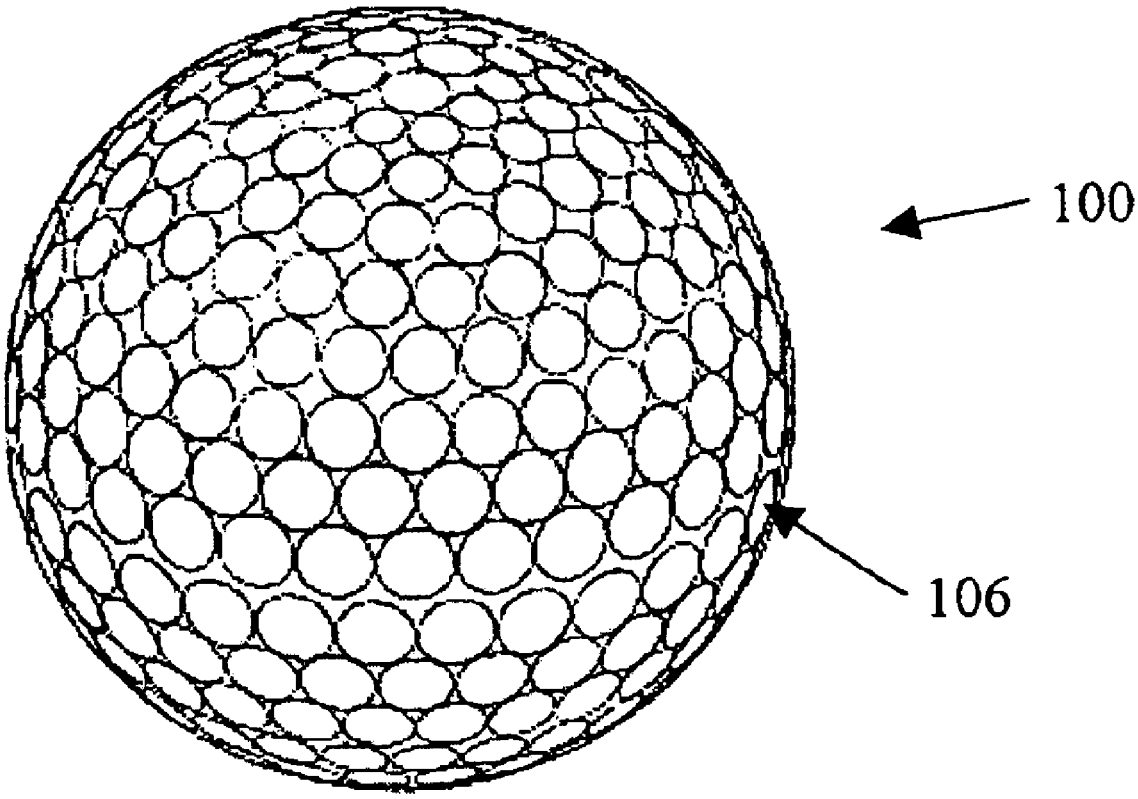
FIG. 10 illustrates an isometric view of a preferred embodiment of a golf ball according to the present invention.
Figure 11:
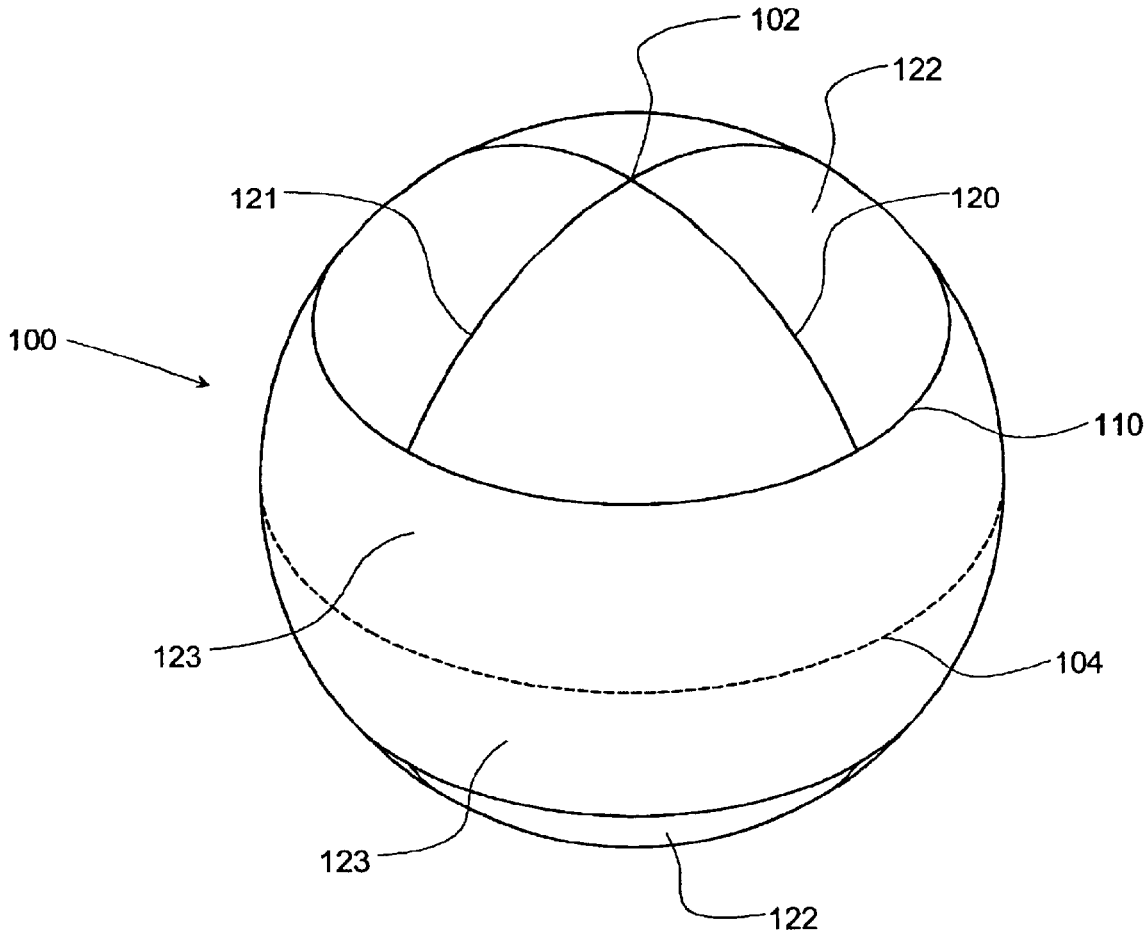
FIG. 11 illustrates the regional divisions of the spherical surface which make up the dimple pattern of the golf ball of FIG. 10.

FIGS. 10–14 illustrate a golf ball 100 with a dimple pattern according to the present invention. FIG. 10 illustrates an isometric view of golf ball 100. FIG. 11 illustrates the regional surface divisions underlying the dimple pattern of golf ball 100 showing a pole 102 and the equator 104 of the golf ball. Each hemisphere includes four triangular areas 122 near the pole and an equatorial band area 123. The triangular areas 122 are delineated by orthogonal great circle arcs 120 and 121, in combination with latitudinal line 110. The equatorial band area 123 is delineated by latitudinal line 110 and the equator 104.

Figure 12:
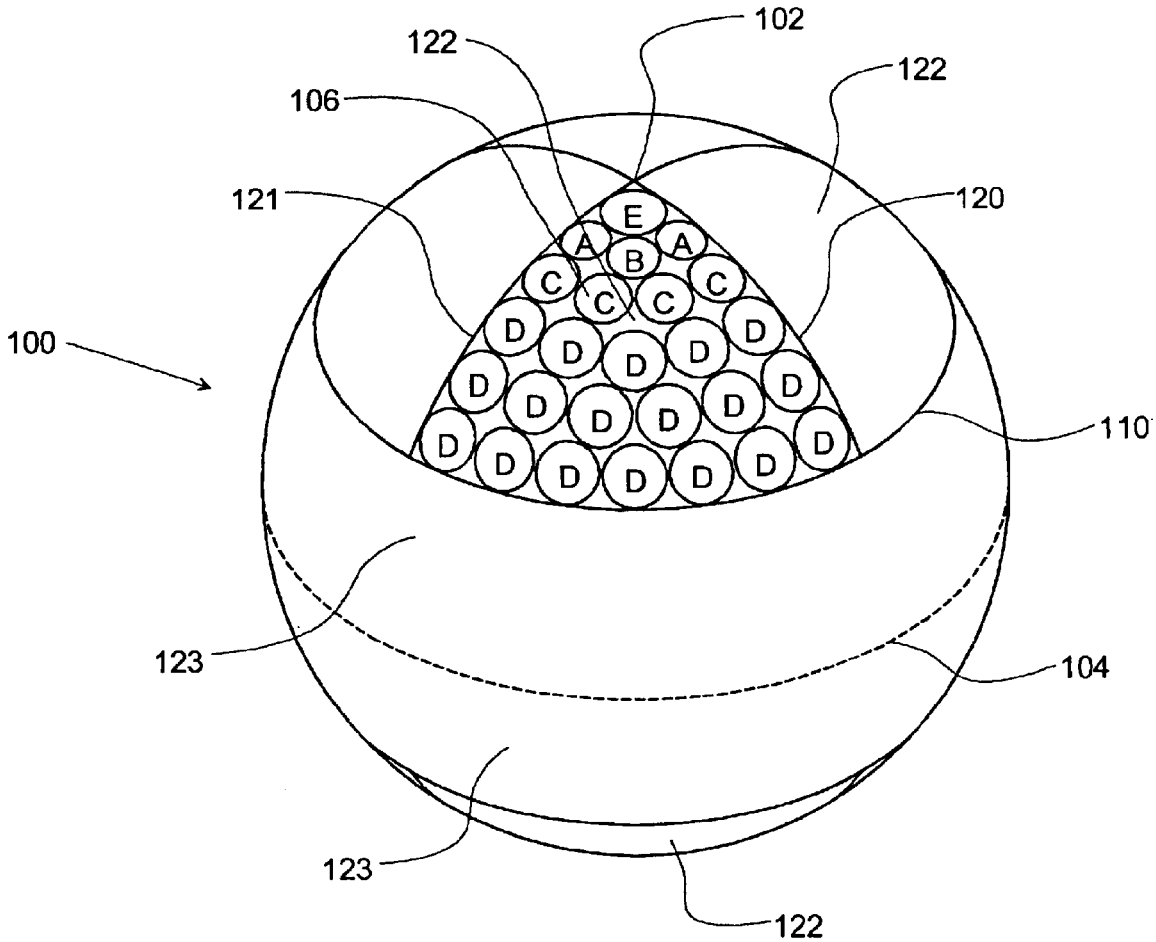
FIG. 12 illustrates a preferred arrangement of dimples used to fill one of the polar regional divisions of FIG. 11.

FIG. 12 illustrates one of the polar regional divisions 122 filled with a preferred arrangement of dimples 106. The dimples are arranged inside of the boundary lines 110, 120, 121. The dimples 106 do not intersect the lines 110, 120, 121. Twenty-six dimples in five different sizes are employed, designated A, B, C, D, and E. Table 3 below provides the diameters for each of these dimple sizes.

TABLE 3

| Dimple | Diameter (in.) |
|---|---|
| A | 0.115 |
| B | 0.120 |
| C | 0.130 |
| D | 0.145 |
| E | 0.150 |

Lines 120, 121 form undimpled great circle arcs that radiate from pole 102. In the illustrated example, lines 120, 121 are perpendicular to equator 104, but this is not required. Alternate embodiments of the present invention may have lines 120, 121 arranged such that they are not perpendicular to equator 104.

Figure 13:
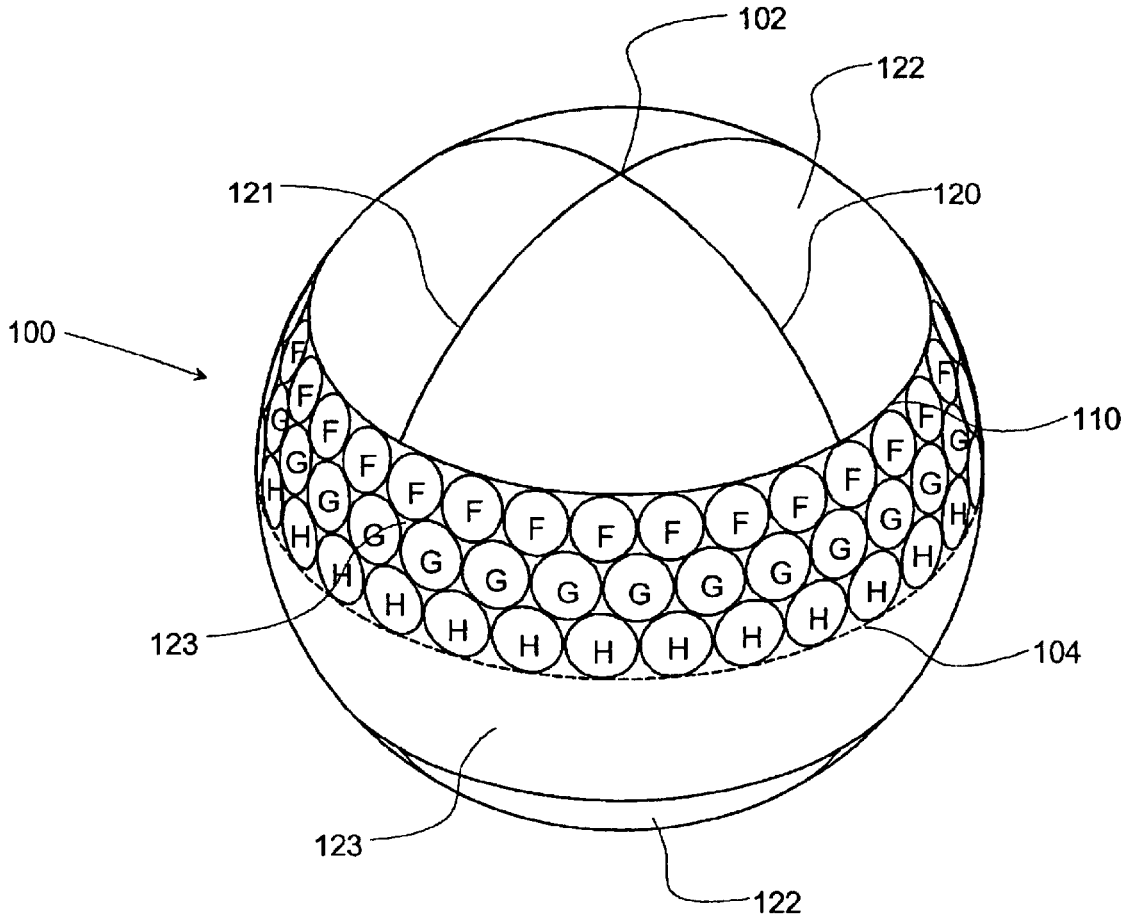
FIG. 13 illustrates a preferred arrangement of dimples used to fill the equatorial regional division of FIG. 11.

FIG. 13 illustrates an equatorial band region 123 filled with a preferred arrangement of dimples 106. Three rows of 30 dimples each are arranged parallel to the equator 104. Each row uses a different dimple size, designated F, G, and H. The corresponding dimple diameters are given in Table 4 below.

TABLE 4

| Dimple | Diameter (in.) |
|---|---|
| F | 0.155 |
| G | 0.165 |
| H | 0.170 |

To facilitate manufacturing of the ball, the lowermost dimples do not intersect equator 104. However, it is understood that these dimples may intersect the equator and interdigitate with dimples from the opposite hemisphere to provide a "seamless" appearance. Alternatively, a row of dimples may be centered along the equator to provide the same effect. In either of these cases, the equatorial band regions 123 of the two opposing hemispheres are effectively merged into a single, wider band.

Figure 14:
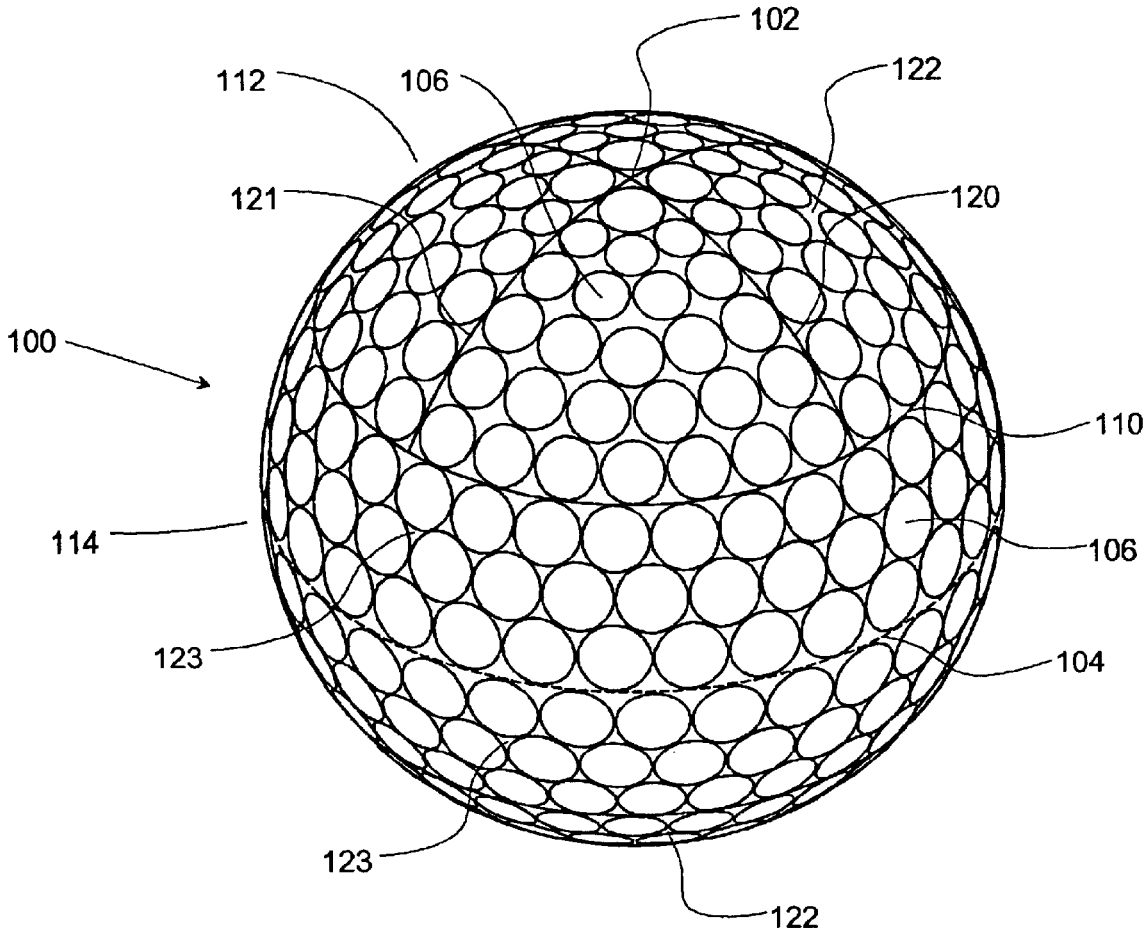
FIG. 14 illustrates a complete preferred dimple pattern comprising all of the regional divisions filled with the dimple arrangements of FIGS. 12 and 13.

FIG. 14 illustrates the complete dimple pattern with all of the polar regional divisions 122 and equatorial band regions 123 filled in as described above, creating a total of 388 dimples 106. Taken collectively, the four regional divisions 122 at each pole form polar zones 112 including 104 dimples each. Similarly, the two equatorial band regions 123 form an equatorial zone 114 including 180 dimples. The boundaries between these zones 112, 114 are latitudinal lines 110.

The dimples 106 within each zone 112, 114 of the dimple pattern are arranged according to distinct dimple packing schemes. In the example shown in FIGS. 10–14, the dimples 106 within zone 112 are positioned according to a scheme characteristic of octahedral dimple patterns, in which many of the dimples 106 do not have hexagonal packing (that is, do not have six adjacent neighbors). The dimples 106 within zone 114 are positioned according to a typical icosahedron dimple-packing scheme, which provides hexagonal packing for all of the dimples except, of course, those along the boundaries of the zone.

The position of line 110 is determined by the number of rows of dimples in the equatorial zone and their sizes. In the illustrated embodiment, it was decided to have three rows of dimples in each of the equatorial zones 123. Lines 110 are positioned immediately above and below the outermost rows of dimples 106 within these zones 123. In this configuration, the equatorial zone 114 covers approximately 52% of the golf ball surface, and the polar zones 112 cover approximately 48% of the golf ball surface.

This dimple pattern results in a unique pole/equator distribution of dimples. One way of quantifying the pole/equator distribution of dimple positions and dimple volume is by the array symmetry index $N_i$ and the volume symmetry index $V_i$, which are defined in U.S. Pat. No. 5,908,359. Index values greater than 1 indicate a bias toward the equator, while values less than 1 indicate a bias toward the pole. Using the diameter values provided in Tables 3 and 4 above, and a dimple edge angle of 15 degrees, we find that $N_i$=0.946 and $V_i$=1.026. Thus, the dimple positions and count are biased toward the poles, but the dimple volume is biased toward the equator. Most dimple patterns have both their dimple positions and their dimple volumes biased toward the pole, which can lead to flight performance that varies depending on the orientation of the ball when struck. This can create difficulties in complying with The Rules of Golf as established by the USGA and The Royal & Ancient Golf Club of St. Andrews, the two ruling bodies for the game of golf. One provision, commonly referred to as "the symmetry rule," requires that a golf ball fly essentially the same distance and for essentially the same amount of time regardless of its orientation when hit. While, like most dimple patterns, the inventive pattern has its dimple positions biased toward the pole, the opposite bias of the dimple volume acts as a balancing factor to produce a ball that flies consistently regardless of orientation.

Although the preferred dimple is circular when viewed from above, the dimples may be oval, triangular, square, pentagonal, hexagonal, heptagonal, octagonal, etc. Possible cross-sectional shapes include, but are not limited to, circular arc, truncated cone, flattened trapezoid, and profiles defined by a parabolic curve, ellipse, semi-spherical curve, saucer-shaped curve, sine curve, or the shape generated by revolving a catenary curve about its symmetrical axis. Other possible dimple designs include dimples within dimples and constant depth dimples. In addition, more than one shape or type of dimple may be used on a single ball, if desired.

The dimple patterns of the present invention can be used with any type of golf ball with any playing characteristics.

For example, the dimple pattern can be used with conventional golf balls, solid or wound. These balls typically have at least one core layer and at least one cover layer. Wound balls typically have a spherical solid rubber or liquid filled center with a tensioned elastomeric thread wound thereon. Wound balls typically travel a shorter distance, however, when struck as compared to a two piece ball. The cores of solid balls are generally formed of a polybutadiene composition. In addition to one-piece cores, solid cores can also contain a number of layers, such as in a dual core golf ball. Covers, for solid or wound balls, are generally formed of ionomer resins, balata, or polyurethane, and can consist of a single layer or include a plurality of layers and, optionally, at least one intermediate layer disposed about the core.

All of the patents and patent applications mentioned herein by number are incorporated by reference in their entireties.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the preferred dimple sizes have been provided above, dimples of other sizes could also be used. Thus the present invention should not be limited by the above-described exemplary embodiments, but should be defined only in accordance with the following claims and their equivalents.

What is claimed is:

1. A golf ball having an outer surface with a plurality of dimples formed therein, the dimples being arranged by dividing the outer surface into eight major spherical triangles, each of the eight major spherical triangles being subdivided into first and second zones, the dimples being arranged according to a first dimple placement scheme in the first zone and according to a second dimple placement scheme in the second zone, wherein the first and second dimple placement schemes are mutually distinct.

2. The golf ball of claim 1, wherein each of the major spherical triangles is substantially identical.

3. The golf ball of claim 1, further comprising poles and an equator, and wherein each major spherical triangle extends from one of the poles to the equator.

4. The golf ball of claim 1, wherein the first zone is a minor spherical triangle and the second zone is a spherical trapezoid.

5. The golf ball of claim 4, wherein four adjacent minor spherical triangles comprise a single distinct region on the ball surface, the region having a common dimple placement scheme throughout.

6. The golf ball of claim 5, wherein the dimple placement scheme within the region includes a subdivision of the region by a plurality of great circle arcs upon which no dimples are formed.

7. The golf ball of claim 4, wherein the eight spherical trapezoids define a single distinct region on the ball surface, the region having a common dimple placement scheme throughout.

8. The golf ball of claim 7, wherein the region is subdivided by a single great circle located at a parting line and upon which no dimples are formed.

9. The golf ball of claim 7, wherein the region cannot be subdivided by an arc of a great circle upon which no dimples are formed.

10. The golf ball of claim 4, further comprising poles and an equator, and wherein:

a first set of four adjacent minor spherical triangles comprise a first distinct region on the ball surface about one of the poles, the first region having a common dimple placement scheme throughout;

the eight spherical trapezoids define a second distinct region on the ball surface about the equator, the second region having a common dimple placement scheme throughout; and a second set of four adjacent minor spherical triangles comprise a third distinct region on the ball surface about the other of the poles, the third region having a common dimple placement scheme throughout.

11. The golf ball of claim 10, wherein the dimple placement schemes of the first and third regions are the same and are distinct from the dimple placement scheme of the second region.

12. The golf ball of claim 1, wherein the first dimple placement scheme comprises an octahedron-based dimple pattern, and the second dimple placement scheme comprises a icosahedron-based dimple pattern.

13. The golf ball of claim 1, wherein the dimples are arranged such that there are a plurality of great circle arcs upon which no dimples are formed, but there is no great circle that does not correspond to a parting line upon which no dimples are formed.

14. The golf ball of claim 13, further comprising two poles and an equator, and wherein each of the arcs extends from a selected one of the poles toward the equator and terminates at a point between the selected pole and the equator.

15. The golf ball of claim 1, wherein the dimples are of eight different sizes.

16. The golf ball of claim 15, wherein the dimples within the first zones comprise five dimple sizes and the dimples within the second zones comprise three dimple sizes.

17. The golf ball of claim 1, wherein there are 388 dimples.

* * * * *